US005134725A

United States Patent [19]

Yeshurun et al.

[11] Patent Number: 5,134,725

[45] Date of Patent: Aug. 4, 1992

[54] COMPOSITE PROTECTIVE BODY AND ITS USE

[75] Inventors: Yehoshua Yeshurun, Haifa; Dan Ziv, M.P. Marom Hagalil, both of Israel

[73] Assignees: The State of Israel, Ministry of Defence, Tel Aviv; Rafael Armament Development Authority, M.P. Moram Haga, both of Israel

[21] Appl. No.: 683,881

[22] Filed: Apr. 11, 1991

[30] Foreign Application Priority Data

Feb. 20, 1991 [IL] Israel ..... 97282

[51] Int. Cl.[5] ..... A41D 13/00; F41H 5/16

[52] U.S. Cl. ..... 2/2.5; 2/2; 2/102; 2/267; 428/911

[58] Field of Search ..... 2/2, 2.5, 4, 16, 24, 2/81, 84, 102, 267, 268, DIG. 3; 428/255, 394, 397, 911

[56] References Cited

U.S. PATENT DOCUMENTS

| | | | |
|---|---|---|---|
| 3,523,057 | 8/1970 | Buck | 428/911 X |
| 3,559,210 | 2/1971 | Hansen | 2/2.5 |
| 3,562,810 | 2/1971 | Davis | 2/2.5 |
| 3,582,988 | 6/1971 | Armellino | 2/2.5 |
| 4,179,979 | 12/1979 | Cook et al. | 428/911 X |
| 4,266,297 | 5/1981 | Atkins | 2/2.5 |
| 4,413,357 | 11/1983 | Sacks | 2/2.5 |
| 4,507,802 | 4/1985 | Small | 2/2.5 |
| 4,578,821 | 4/1986 | Zufle | 2/2.5 |
| 4,602,385 | 7/1986 | Warren | 2/2.5 X |
| 4,905,320 | 3/1990 | Squyers, Jr. | 2/2.5 X |
| 5,073,985 | 12/1991 | Stone et al. | 2/2.5 X |

*Primary Examiner*—Werner H. Schroeder
*Assistant Examiner*—Jeanette E. Chapman
*Attorney, Agent, or Firm*—Helfgott & Karas

[57] ABSTRACT

A composite protective body suitable, among others, for making protective garments comprises a pliable flat case with at least one panel of soft ballistic material, and an insert within the case. The insert is composed of a plurality of consituent bodies of glass or ceramic material. The constituent bodies of the insert are of axisymmetrical or centrosymmetrical shape and of a size commensurate with that of the kinetic missiles against which protection is to be afforded. The bodies are arranged in at least two superimposed layers in each of which the constituent bodies are spaced from each other by a distance smaller than the size of a body with each body in one layer bridging a gap between two bodies of the adjacent layer. Each constituent body of the insert is glued to all surrounding bodies by thermoplastic or thermosetting material.

9 Claims, 2 Drawing Sheets

COMPOSITE PROTECTIVE BODY AND ITS USE

FIELD OF THE INVENTION

The present invention is in the field of protection against kinetic missiles such as firearm bullets, as well as against knife-thrusts, and aims at providing pliable composite protective bodies suitable for incorporation in protective garments such as bullet-proof vests and for providing an outer armour on enclosures such as, for example land vehicles, marine vessels and aircraft. The invention further concerns improved protective garments.

BACKGROUND OF THE INVENTION AND PRIOR ART

Known protective garments such as bullet-proof vests, comprise as a rule of so-called ceramic ballistic plates as a rule in combination with a so-called ballistic material, e.g. soft panels made of Kevlar (Trade Mark, Du Pont), Spectra (Trade Mark, Allied Chemicals), Aramid (Trade Mark) and the like. In the ceramic plate insert which, depending on the intended use, may be flat or curved, the individual plates are densely laid out with neighbouring plates tightly bearing on each other.

The insert forming plates in known composite protective bodies of the kind specified are usually large relative to the diameter of the kinetic energy missile against which it is to afford protection, e.g. of the order of 5 $cm^2$. Where the composite body has only one single ceramic plate layer it affords a relatively low multi-hit capability since every hit destroys one of the plates leaving a relatively large unprotected area. In some known bullet-proof vests the multi-hit capability is improved by provision of inserts with two or more mutually staggered overlapping layers of ceramic ballistic plates. However, this renders the vest relatively heavy and gives rise to significant discomfort of the wearer.

SUMMARY OF THE INVENTION

It is the object of the present invention to provide an improved, relatively light-weight composite protective body of the kind specified.

It is a further object of the present invention to provide an improved insert for a protective garment.

It is yet another object of the invention to provide improved protective garments.

In the following description and claims, the expression "ballistic material" means a pliable woven or non-woven material capable of absorbing the kinetic energy of a missile such as a firearm bullet and thereby damping a missile to a large extent; and the term "size" when used in relation to kinetic energy missiles or ceramic bodies means width or diameter.

In accordance with one aspect of the present invention there is provided a composite protective body comprising a pliable flat case with at least one panel of soft ballistic material and an insert within the case comprising a plurality of constituent bodies of glass or ceramic material, characterised in that the constituent bodies of the insert are of axisymmetrical or centrosymmetrical shape and of a size commensurate with that of the kinetic missiles against which protection is to be afforded and are arranged in at least two superimposed layers in each of which the constituent bodies are spaced from each other by a distance smaller than the size of a body with each body in one layer bridging a gap between two bodies of another layer, and in that each constituent body of the insert is glued to all surrounding bodies by thermoplastic or thermosetting material.

The axisymmetric or centrosymmetric insert constituting glass or ceramic bodies employed in accordance with the invention may be of any suitable shape such as spherical, ellipsoidal, cylindrical, prismatic, pyramidal and the like, spherical bodies being preferred.

Due to the fact that in a composite body according to the invention the individual ballistic bodies are spaced from each other with the gaps between bodies in one layer being bridged by a body of another layer, the composite protective bodies according to the invention combine a relative light weight with a good multi-hit capability. The multi-hit capability is enhanced by the fact that the size of the ballistic bodies is commensurate with that of the missiles against which protection is to be afforded. Typically, the size of a body may be between $\frac{1}{3}$ and twice the size of an oncoming missile. For example, spherical ballistic glass or ceramic bodies having a diameter from 4–18 mm may afford adequate protection against all conventional small calibre firearms.

In use a composite protective body according to the invention is placed with the insert turned towards the environment. In operation, an impinging kinetic missile such as a firearm bullet is effectively deflected from its original trajectory and damped by the insert body or bodies which it hits to such an extent that it is subsequently captured by the soft ballistic material panel of the case.

Obviously a protective body according to the invention also provides protection with good multi-hit capability against knife thrusts.

For incorporation of a composite protective body according to the invention in a protective garment such as a bullet-proof vest, it may be fabricated in a shape most suitable for that purpose.

By another aspect the invention provides for incorporation in a protective garment a cohesive pliable insert comprising a plurality of axisymmetrical or centrosymmetrical constituent bodies of glass or ceramic material arranged in at least two layers in each of which the constituent bodies are spaced from each other by a distance smaller than the size of a body with each body in one layer bridging the gap between the bodies in another layer, each constituent body being glued to all surrounding bodies by thermoplastic or thermosetting material.

By yet another aspect the invention provides a protective garment having a cohesive pliable insert comprising a plurality of axisymmetrical or centrosymmetrical constituent bodies of glass or ceramic material arranged in at least two layers in each of which the constituent bodies are spaced from each other by a distance smaller than the size of a body with each body in one layer bridging the gap between the bodies in another layer, each constituent body being glued to all surrounding bodies by thermoplastic or thermosetting material.

DESCRIPTION OF THE DRAWINGS

For better understanding the invention will now be described, by way of example only and without limitation, with reference to the annexed drawings in which.

DESCRIPTION OF SPECIFIC EMBODIMENTS

Figure 1:
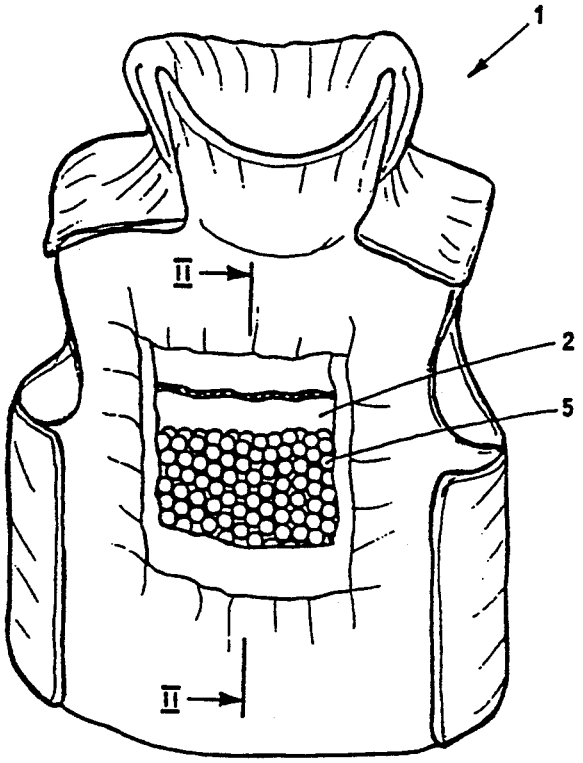
FIG. 1 is a front view, partly broken open of a bullet-proof vest comprising a composite protective body according to the invention.
Figure 2:
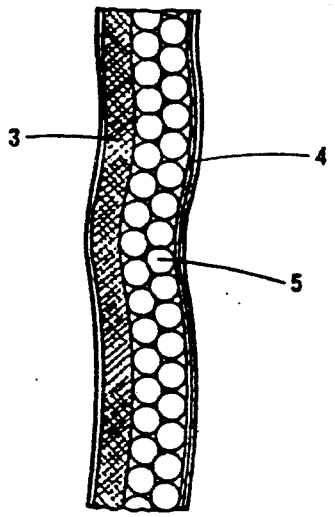
FIG. 2 is a section along line II—II of FIG. 1.

Referring first to FIGS. 1 and 2, there is shown a bullet-proof vest having a front and back composite protective body made in accordance with the invention, only one of which is seen. As shown the vest 1 has a front composite protective body 2 comprising a case with a back panel 3 of a soft ballistic material such as Kevlar (Trade Mark, Du Pont) and a front sheet 4, holding an insert comprising a plurality of spherical ceramic bodies 5. As seen in FIG. 2 the ballistic ceramic bodies 5 are arranged in two rows with the bodies in each row being spaced from each other and the gap between them being bridged by a body of the other row. Each of the bodies 5 is glued to all surrounding bodies.

A composite protective body of the kind shown in FIGS. 1 and 2 was subjected to a shooting test. In the tested body the soft ballistic material panel 3 was 12 mm thick and made of Kevlar (Trade Mark, Du Pont) while the front sheet 4 was of ordinary cloth. The ceramic spherical bodies 5 measured 9.5 mm in diameter and were made of alumina. All constituent balls were glued together in the manner specified by means of the thermoplastic-polyester Hytrel (Trade Mark, Du Pont). Armour piercing bullets fired from an automatic assault rifle AK-47 (known as Kalashnikov) from a distance of 10 meters were stopped and did not penetrate across the protective body.

Figure 3:
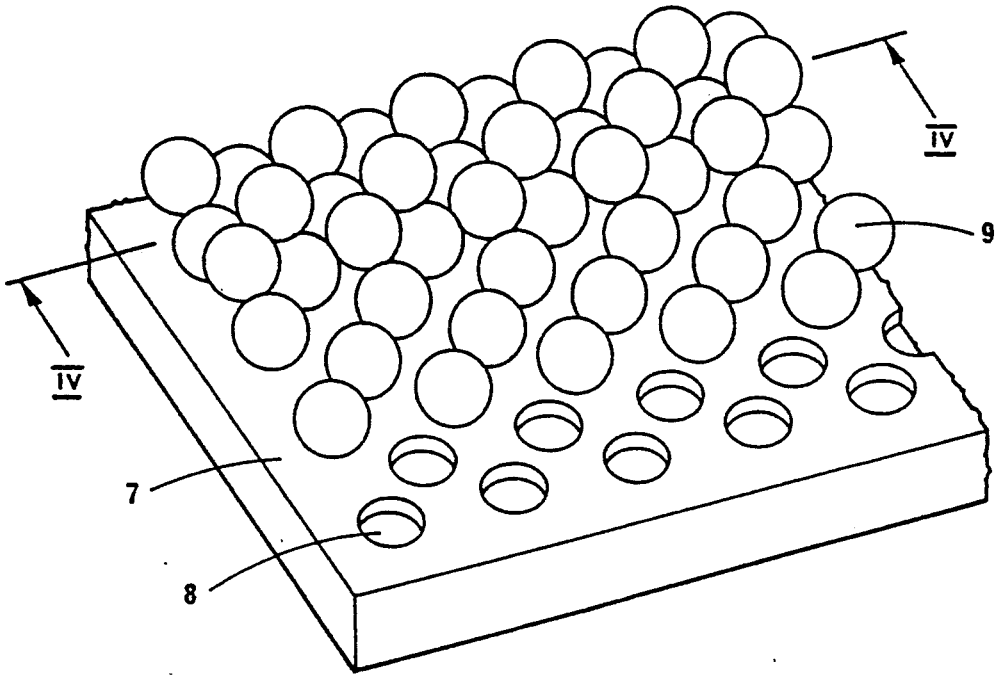
FIG. 3 is a diagrammatic perspective illustration of a phase in the manufacturing process.
Figure 4:
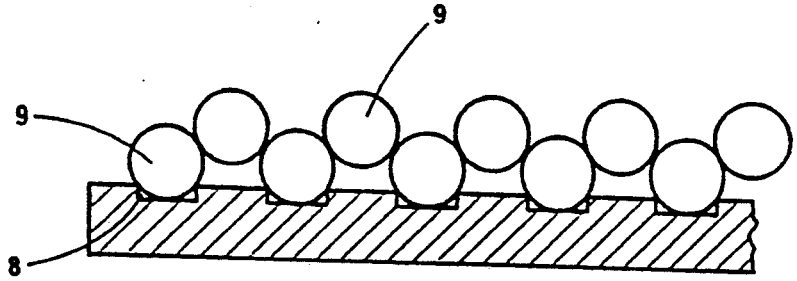
FIG. 4 is a section along lines IV—IV of FIG. 3.

Attention is now directed to FIGS. 3 and 4 which show a sintering fixture for the preparation of a ceramic body insert according to the invention. The figure 7 has a plurality of depressions 8 each capable of holding a ceramic or glass sphere 9. As shown in FIG. 4, the first, bottom layer of ceramic spheres 9 is covered with a second, top layer of identical bodies such that each body 9 of the top layer bridges the gap between two bodies 9 of the bottom layer and likewise each body 9 of the lower layer bridges the gap between two bodies 9 of the upper one. FIG. 3 shows an intermediary phase in the arrangement of spheres 9 in sintering fixture 7.

In the course of production, spheres 9 are first subjected to a treatment by which they are coated with suitable thermoplastic or thermosetting material, as will be described in Examples 1 and 2 below, and once placed in fixture 7 they are subjected to sintering in a suitable oven. After cooling, a cohesive two-layer insert structure of ceramic spherical bodies is withdrawn from the form and is ready for insertion in a case for forming a composite protective body according to the invention.

The preparation of cohesive inserts of ceramic spheres of the kind referred to above is further described in the following Examples.

EXAMPLE 1

Alumina spheres having a uniform diameter of 9.5 mm were heated to 160° C. for 30 minutes and then immersed in a powder bed of the thermoplastic copolyester Hytrel (Trade Mark, Du Pont), whereby the alumina spheres were coated by a 0.5 mm thick uniform layer of the thermoplastic material. Following cooling, the coated spheres were placed in a sintering fixture of the kind illustrated in FIGS. 3 and 4 and placed for 25 minutes in an oven for sintering at 160° C. After cooling a cohesive two-layer insert body of coated ceramic spheres was withdrawn from the sintering fixture. The insert was pliable and could be bent without damage at internal and external radii of curvature of, respectively, 40 and 56 mm.

The total thickness of the body was 16 mm. It was attached to a 12 mm thick Aramid (Trade Mark) panel and a shooting test was performed as described hereinbefore.

Cohesive insert bodies produced in this manner are ready for further use and processing in accordance with the teaching of this invention.

EXAMPLE 2

Alumina spheres having a uniform diameter of 9.5 mm were placed into a sintering fixture of the kind illustrated in FIGS. 3 and 4. Liquid room temperature vulcanising (RTV) silicone was poured at room temperature onto the spheres. Following degassing in a manner known per se to remove trapped air, the sintering fixture was placed in an oven and heated for 30 minutes at 100° C. The resulting cohesive insert body was ready for further processing in accordance with the present invention.

We claim:

1. A composite protective body comprising a pliable flat case with at least one panel of soft ballistic material, and an insert placed within the case and including a plurality of constituent bodies made of a material selected from the group consisting of glass and ceramic materials, said bodies each having a configuration selected from the group consisting of axisymmetrical and centrosymmetrical configuration, said constituent bodies having a size commensurate with that of kinetic missiles against which protection is to be afforded and being arranged in at least two superimposed layers each constituent body in each layer being spaced from each neighboring body in the same layer by a distance smaller than the size of the constituent body with each body in one layer bridging a gap between two bodies in another layer, each constituent body of the insert being glued to neighboring bodies in another layer by a gluing material selected from the group consisting of thermoplastic and thermosetting materials so as to form a self-supporting cohesive multi-layer, pliable insert, said insert being placed in said case without securing said insert to said case, whereby said insert can be bent without damage.

2. The composite protective body of claim 1, wherein said constituent bodies are spherical.

3. The composite body of claim 1, wherein said constituent bodies are coated by said gluing material.

4. For incorporation in a protective garment a pliable insert comprising a plurality of constituent bodies made of a material selected from the group consisting of glass and ceramic materials and having a configuration selected from the group consisting of axisymmetrical and centrosymmetrical configurations, said constituent bodies having a size commensurate with that of kinetic missiles against which protection is to be afforded and are arranged in at least two superimposed layers each constituent body in each layer being spaced from each neighboring body in the same layer by a distance smaller than the size of the constituent body with each body in one layer bridging the gap between two bodies of another layer, each constituent body of the insert being glued to surrounding bodies in another layer by a gluing material selected from the group consisting of thermoplastic and thermosetting materials so as to form a self supporting cohesive multi-layer, pliable insert, whereby said insert can be bent without damage.

5. The insert of claim 4, wherein said constituent bodies are spherical.

6. The insert of claim 4, wherein said constituent bodies are coated by said gluing material.

7. A protective garment comprising a pliable insert including a plurality of constituent bodies made of a material selected from the group consisting of glass and ceramic materials and having a configuration selected from the group consisting of axisymmetrical and centrosymmetrical configurations, said constituent bodies having a size commensurate with that of kinetic missiles against which protection is to be afforded and being arranged in at least two superimposed layers in each constituent body in each layer being spaced from each neighboring body in the same layer by a distance smaller than the size of the constituent body with each body in one layer bridging a gap between two bodies of another layer, each constituent body of the insert being glued to surrounding bodies in another layer by a gluing material selected from the group consisting of thermoplastic and thermosetting materials so as to form a self supporting cohesive multi-layer, pliable insert, whereby said insert can be bent without damage.

8. A method of making a composite protective body, comprising the steps of providing a pliable flat case with at least one panel of soft ballistic material, providing a plurality of constituent bodies made of a material selected from the group consisting of glass and ceramic materials, said bodies each having a configuration selected from the group consisting of axisymmetrical and centrosymmetrical configuration, said constituent bodies having a size commensurate with that of kinetic missiles against which protection is to be afforded, arranging said constituent bodies in at least two superimposed layers each constituent body in each layer being spaced from each neighboring body in the same layer by a distance smaller than the size of the constituent body with each body in one layer bridging a gap between two bodies in another layer, coating said bodies arranged in said at least two layers by a thermoplastic material to glue said bodies to each other so as to form an multi-layer, pliable insert body of self supporting cohesive structure, and placing said insert body within said case without securing said insert body to said case.

9. A method of making a composite protective body, comprising the steps of providing a pliable flat case with at least one panel of soft ballistic material, providing a plurality of constituent bodies made of a material selected from the group consisting of glass and ceramic materials, said bodies each having a configuration selected from the group consisting of axisymmetrical and centrosymmetrical configuration, said constituent bodies having a size commensurate with that of kinetic missiles against which protection is to be afforded, arranging said constituent bodies in at least two superimposed layers each constituent body in each layer being spaced from each neighboring body in the same layer by a distance smaller than the size of the constituent body with each body in one layer bridging a gap between two bodies in another layer, coating said bodies arranged in said at least two layers by a thermosetting material to glue said bodies to each other so as to form an multi-layer, pliable insert body of self supporting cohesive structure, and placing said insert body within said case without securing said insert body to said case.

* * * * *

UNITED STATES PATENT AND TRADEMARK OFFICE

CERTIFICATE OF CORRECTION

PATENT NO. : 5,134,725

DATED : August 4, 1992

INVENTOR(S) : YEHOSHUA YESHURUN AND DAN ZIV

It is certified that error appears in the above-identified patent and that said Letters Patent is hereby corrected as shown below:

On the title page, please change line [73] to read:

--[73] Assignees: The State of Israel, Ministry of Defence, RAFAEL ARMAMENT DEVELOPMENT AUTHORITY, Tel-Aviv;

PLASAN-SASA, Israel Limited partnership, M.P. Marom Hagalil, both of Israel--

Signed and Sealed this

Tenth Day of May, 1994

Bruce Lehman

*Attest:*

BRUCE LEHMAN

*Attesting Officer*

*Commissioner of Patents and Trademarks*